United States Patent [19]

Shibano

[11] Patent Number: 5,035,652

[45] Date of Patent: Jul. 30, 1991

[54] MULTIPIN CONNECTOR SOCKET

[75] Inventor: Yasuji Shibano, Izumisano, Japan

[73] Assignee: Hosiden Electronics Co., Ltd., Osaka, Japan

[21] Appl. No.: 521,997

[22] Filed: May 11, 1990

[30] Foreign Application Priority Data

May 22, 1989 [JP] Japan ..... 1-59222[U]

[51] Int. Cl.[5] ..... H01R 9/03

[52] U.S. Cl. ..... 439/610; 439/108; 439/847

[58] Field of Search ..... 439/607, 609, 610, 92, 439/95, 847, 108

[56] References Cited

U.S. PATENT DOCUMENTS

| | | | |
|---|---|---|---|
| 4,449,778 | 5/1984 | Lane | 439/610 |
| 4,637,669 | 1/1987 | Tajima | 439/95 |
| 4,842,554 | 6/1989 | Cosmos et al. | 439/609 |
| 4,925,405 | 5/1990 | Wei | 439/609 X |
| 4,936,795 | 6/1990 | Kawai et al. | 439/609 |

*Primary Examiner*—David L. Pirlot
*Assistant Examiner*—Julie R. Daulton
*Attorney, Agent, or Firm*—Pollock, Vande Sande and Priddy

[57] ABSTRACT

In a multipin connector socket a rectangular body of an insulating material, with socket contacts housed therein in rows and columns, is received in a tubular metallic shield cover, which is, in turn, received in a square tubular case of an insulating material, defining therebetween a square groove for receiving a shell of the mating connector plug inserted thereinto from the front. The front of the socket portion of the case is covered with a metallic square tubular ground cover, and lugs set up from the shield cover are engaged with slots of the ground cover, by which the shield cover and the ground cover are electrically connected to each other. Spring pieces extending from the ground cover project into the square groove for elastically contacting the shell of the mating connector plug when the plug is inserted into the square groove.

8 Claims, 6 Drawing Sheets

MULTIPIN CONNECTOR SOCKET

BACKGROUND OF THE INVENTION

The present invention relates to a multipin connector socket which has a relatively large number of contacts and, more particularly to a multipin connector socket which has an electromagnetic shield.

In conventional multipin connector sockets of this type, a square body of an insulating material has housed therein a plurality of contacts and is covered with a metallic square tubular shield cover, on which a square tubular case of an insulating material is put, as disclosed in U.S. Pat. No. 4,854,895. Thus, the prior art connector sockets are covered with insulators and hence do not adequately prevent electromagnetic failure of electronic devices which are connected to the sockets.

SUMMARY OF THE INVENTION

It is therefore an object of the present invention to provide a multipin connector socket which has an excellent electromagnetic shield.

.According to the present invention, a square tubular ground cover is put on the insulating case of the conventional multipin connector socket from its front. The ground cover is made by punching and bending a metal plate. Lug pieces set up from a shield cover are engaged with slots made in side panels of the ground cover, and spring pieces formed integrally with the ground cover are positioned in a square groove. The square groove is defined in the front of the socket by the shield cover and the insulating case, for receiving a shell of the mating connector plug.

DESCRIPTION OF THE PREFERRED EMBODIMENTS

Figure 1:
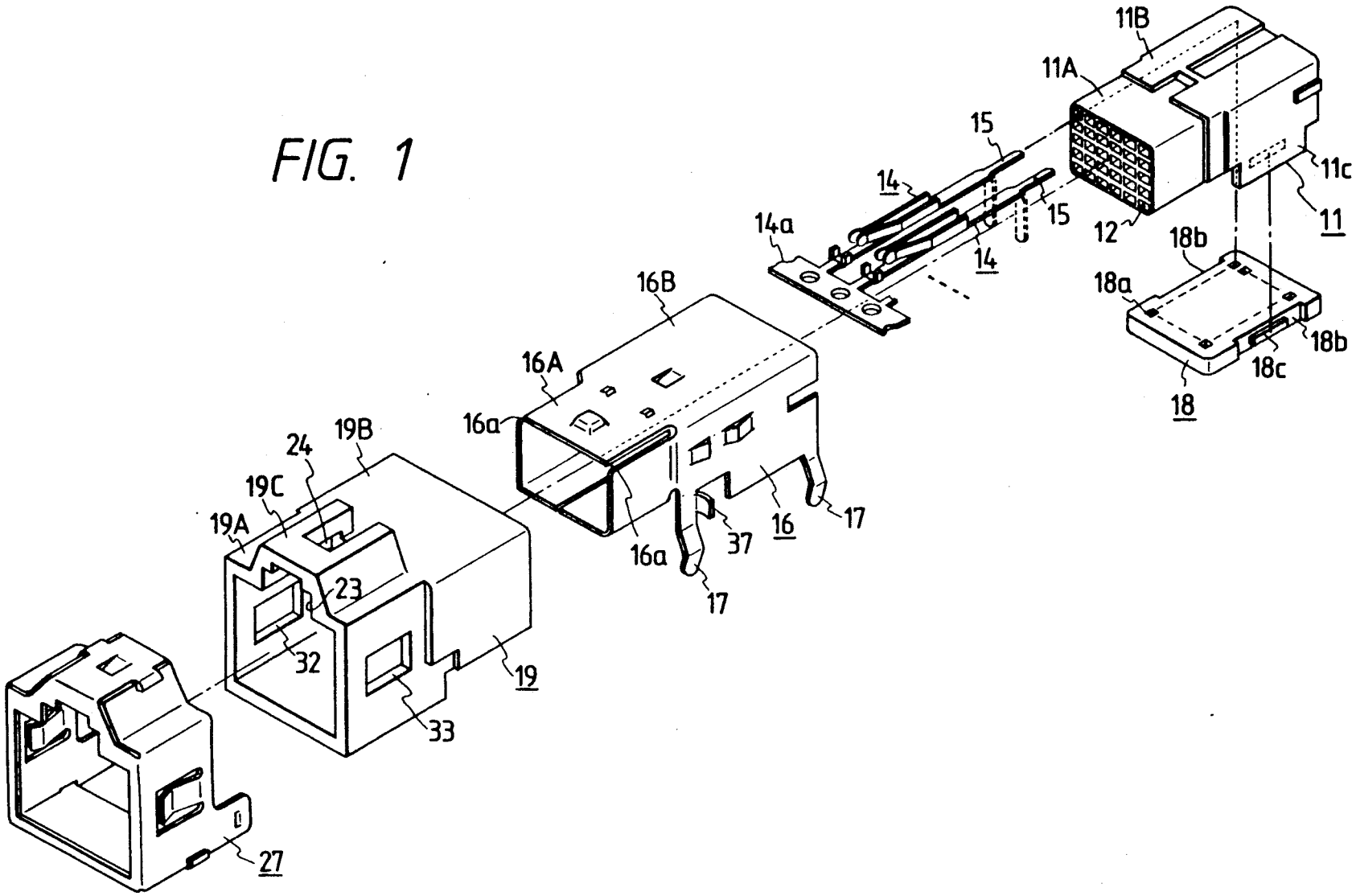
FIG. 1 is an exploded perspective view of the multipin connector socket of the present invention.

FIGS. 1 through 9 illustrate an embodiment of the multipin connector socket of the present invention. FIG. 1 is its exploded perspective view. As shown in FIG. 1, the multipin connector socket of this embodiment comprises a rectangular insulating body 11, a plurality of socket contacts 14 which are housed in the body 11, a shield cover 16 which is secured to the body 11 on the outside thereof, a holder 18 of an insulating material which is attached to the bottom of the body 11 to hold terminals of the socket contacts 14, a case 19 of an insulating material which is mounted on the outside of the shield cover 16, and a ground cover 27 which is put on the outside of the front half portion of the case 19.

The insulating body 11 consists of a block portion 11A and a terminal housing portion 11B formed integrally therewith at the rear thereof. The block portion 11A has a plurality of socket contact housing holes 12 extending therethrough in the front-to-back direction and arranged in rows and in columns. The terminal housing portion 11B is slightly larger in width and in thickness than the block portion 11A and forms a compartment 13 (see FIG. 6) open at the rear and the bottom. The socket contacts 14 of each array, formed together with a carrier portion **14*a* by punching press work of a metal plate, are inserted into the contact housing holes 12 from their front open ends, after which the carrier portion 14*a* is cut off. Terminals 15 of the contacts 14 project out rearwardly of the block portion 11A of the body 11 and into the compartment 13 of the terminal housing portion 11B, in which they are bent downward at right angles at positions corresponding to terminal receiving holes 18*a* made in the holder 18, respectively. The holes 18*a* are also arranged in rows and columns. The holder 18 has in its both side marginal portions recesses 18*b*, in each of which there is provided an engaging protrusion 18*c*. The holder 18 with the terminals 15 received in its terminal receiving holes 18*a* is secured to the terminal housing portion 11B from below while being held between legs 11c extending downward from the side walls of the terminal housing portion 11B and fitted in the recesses 18*b* of the holder 18. Thus, the holder 18 forms the bottom of the compartment 13**.

The shield cover 16 consists of a square tubular portion 16A which receives the block portion 11A of the body 11 and a U-shaped frame portion 16B which has an inverted U-shaped cross-section and covers the terminal housing portion 11B of the body 11. The square tubular portion 16A and the U-shaped frame portion 16B are formed as one piece by punching press work of a metal plate. The square tubular portion 16A has slits **16*a* extending along its upper marginal edges on both sides. The U-shaped frame portion 16B is open at its bottom and rear and has ground terminals 17 extending down from the lower edge of its two side panels at the front and rear thereof. The ground terminals 17 at the forward portion each have a lug 37 (36) extending from at least one of its marginal edges at right angles to the side panel of the frame portion 16B. The body 11 with the contacts 14 and the holder 18 incorporated therein is inserted into the shield cover 16 from behind. In the state in which the body 11 is received in the shield cover 16, the rear end portion of the square tubular portion 16A grips the forward portion of the terminal housing portion 11B larger than the block portion 11A. Consequently, a gap 20 is formed between the square tubular portion 16A and the block portion 11A, permitting the top and side panels of the square tubular portion 16A to be elastically displaced into direct contact with the outer wall surface of the block 11A**.

The insulating case 19 also consists of a square tubular portion 19A and a frame portion 19B formed as one piece. The frame portion 19B has an inverted U-shaped cross-section and is open at the bottom and rear. The square tubular portion 19A has on its top a raised portion 19C, which has in its inner wall a guide recess 23 extending rearwardly from the front open end of the square tubular portion 19A for guiding a locking slider 49 and a locking piece 25 of the mating connector plug (see FIG. 9). The raised portion 19C has an engaging hole 24 open at the top thereof and communicating with the guide recess 23. When the mating connector plug is inserted into the connector socket, the locking piece 25 of the former is guided by the recess 23 into engagement with the engaging hole 24, locking the plug and socket to each other. The two side walls of the square tubular portion 19A have windows 32 and 33. The shield cover 16 with the body 11 received therein is inserted into the case 19 from behind, thereby forming a square groove 22 between the square tubular portions 16A and 19A of the shield cover 16 and the case 19 for receiving a square shell 21 of the mating connector plug (see FIGS. 7 and 8) as shown in FIG. 2.

Figure 2:
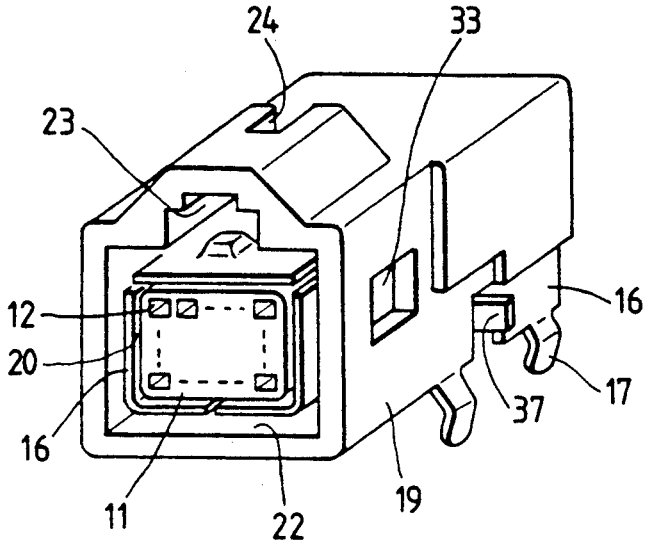
FIG. 2 is a perspective view, with a ground cover 27 taken away.
Figure 3:
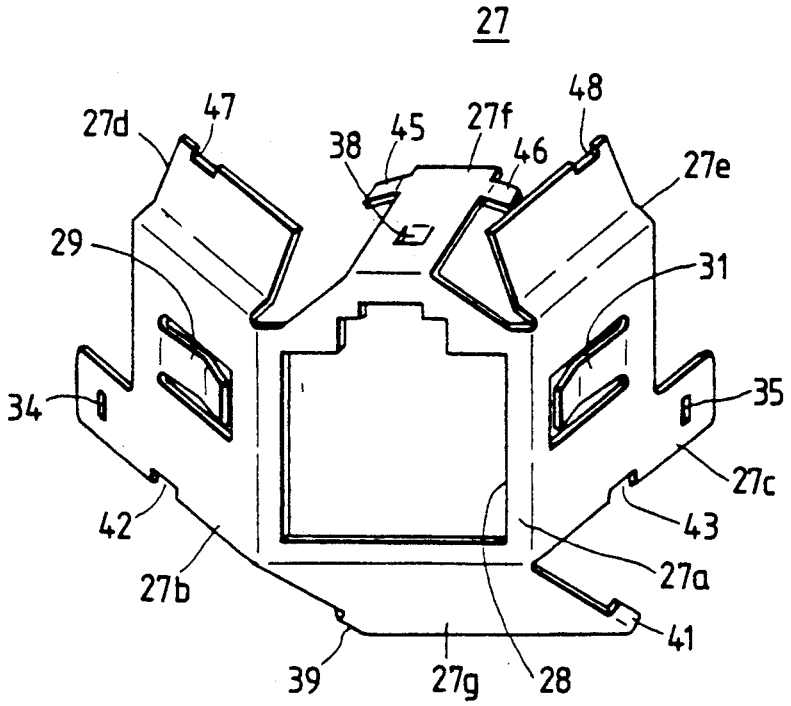
FIG. 3 is a perspective view showing the step of forming the ground cover 27.
Figure 4:
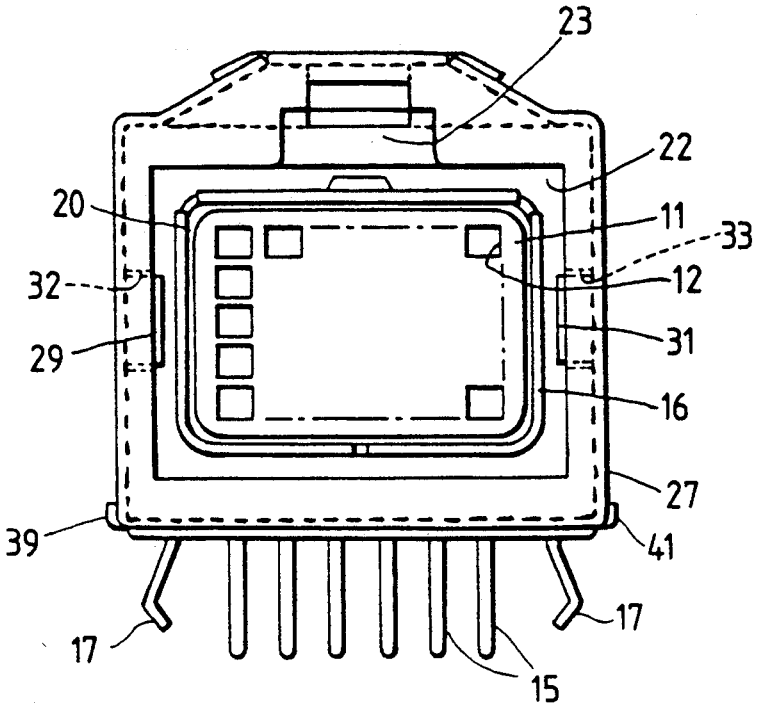
FIG. 4 is a front view of the assembled multipin connector socket.
Figure 5:
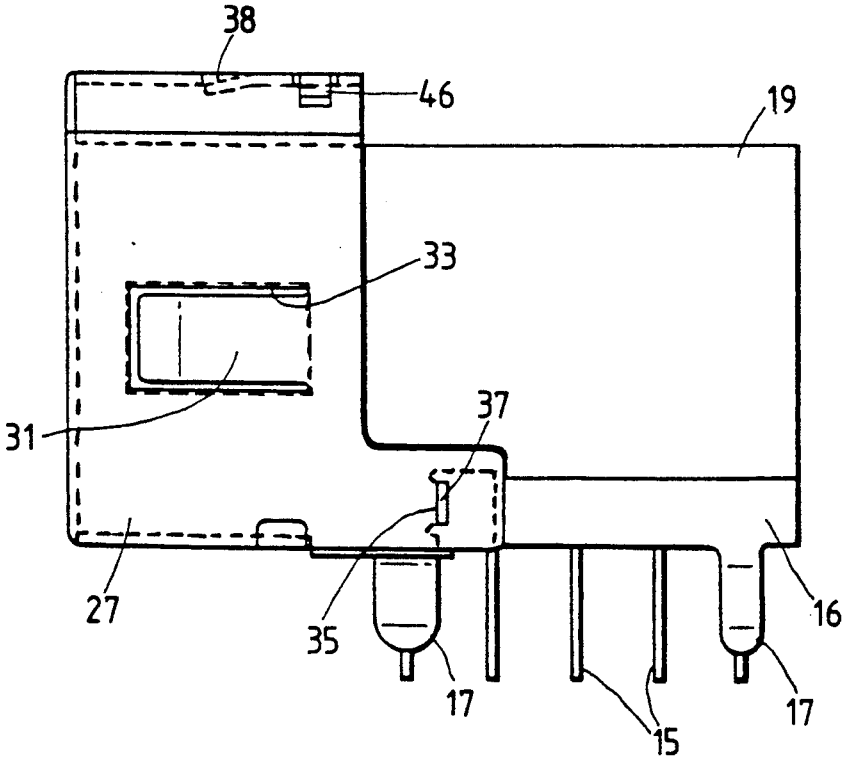
FIG. 5 is a side view of the multipin connector socket shown in FIG. 4.
Figure 6:
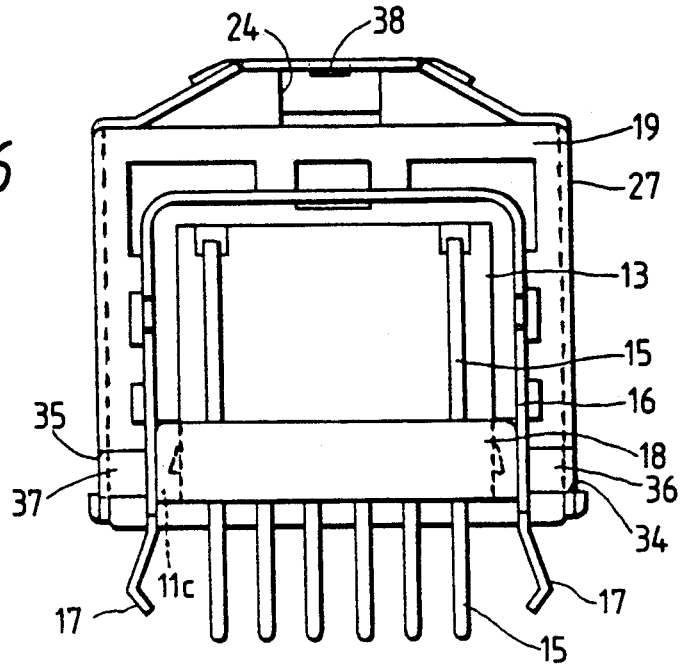
FIG. 6 is a rear view of the multipin connector socket shown in FIG. 4.

The ground cover 27 is put on the forward portion of the socket assembly shown in FIG. 2, i.e. on the square tubular portion 19A of the case 19. The ground cover 27 is made by punching and bending a metal plate as depicted in FIG. 3, for instance. That is, a front panel 27*a* of substantially the same shape as that of the front end of the case 19 has an opening 28 which is also of about the same shape as the opening of the square tubular portion 19A of the case 19. Left and right side panels 27*b* and 27*c* extend rearwardly from both marginal edges of the front panel 27*a*, and side portions 27*d* and 27*e* of the top panel extend inwardly from upper edges of the side panels 27*b* and 27*c*. A central portion 27*f* of the top panel extends rearwardly from the upper edge of the front panel 27*a* centrally thereof, and a bottom panel 27*g* extends rearwardly from the lower edge of the front panel 27*a*.

The two side panels 27*b* and 27*c* have spring pieces 29 and 31 formed by U-shaped grooves cut therein and extending in the front-to-back direction. When the ground cover 27 is put on the case 19, the spring pieces 29 and 31 project into the square tubular portion 19A through the windows 32 and 33 made in its two side panels and lie in the square groove 22. The side panels 27*b* and 27*c* have in their lower rearward extensions slots 34 and 35, with which the lugs 36 and 37 (see FIGS. 1, 2 and 6) set up from the lower marginal portions of the both side panels of the shield cover 16 are engaged, thereby mechanically and electrically connecting the ground cover 27 to the shield cover 16.

Figure 8:
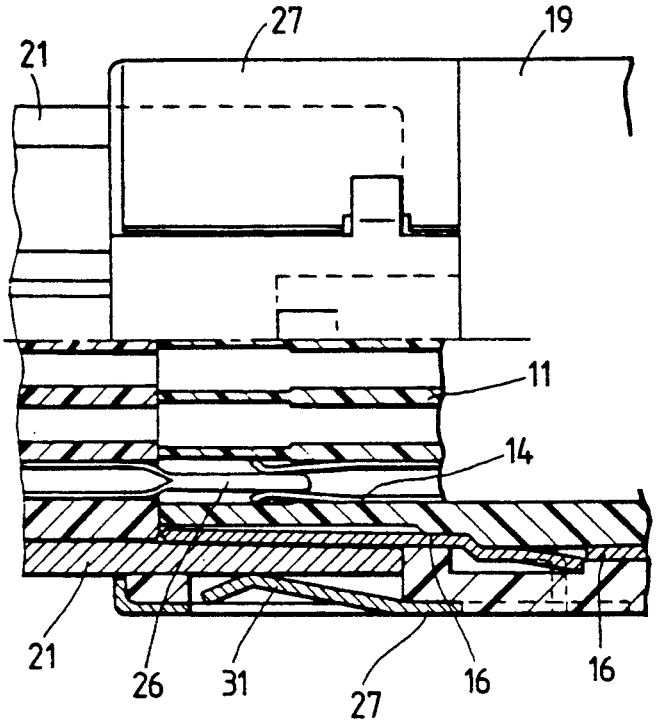
FIG. 8 is a plan view, partly in section, showing the connection of the multipin connector socket to the mating connector.

Moreover, the top panel 27*f* has an inwardly projecting stopper 38 provided centrally thereof, as required, for engagement with the front edge of the engaging hole 24 made in the top of the raised portion 19C as shown in FIGS. 1 and 8, thus preventing the cover 27 from coming off. The bottom panel 27*g* has claws 39 and 41 set up from its two marginal edges at the rear thereof and the claws 39 and 41 are engaged with notches 42 and 43 made in the lower edges of the side panels 27*b* and 27*c*. The top panel 27*f* has claws 45 and 46 projecting out from its two sides at the rear thereof and the claws 45 and 46 are engaged with notches 47 and 48 made in the top panels side portions 27*d* and 27*e*.

Figure 7:
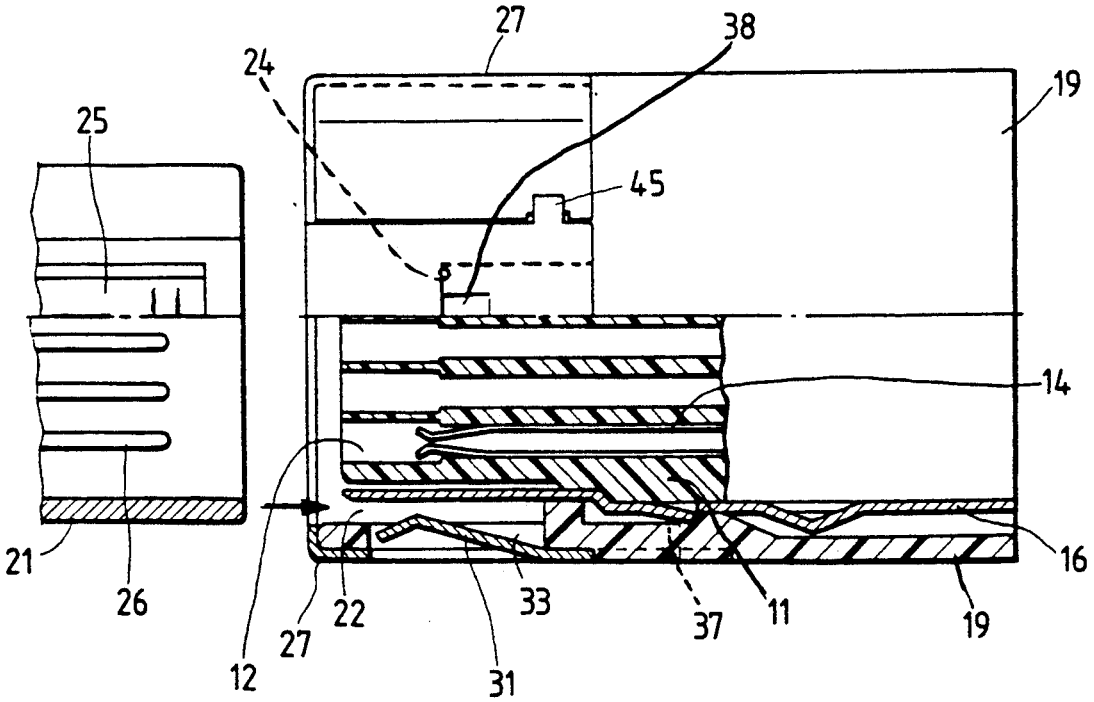
FIG. 7 is a plan view, partly in section, illustrating an embodiment of the present invention.
Figure 9:
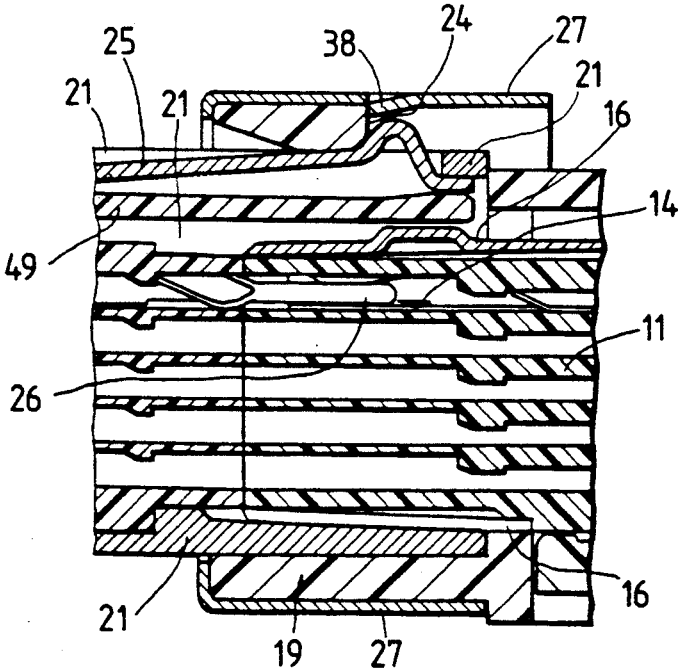
FIG. 9 is a vertical sectional view of FIG. 8.

When the mating connector plug is inserted into the connector socket, pin contacts 26 of the plug elastically contact the contacts 14 of the socket as depicted in FIGS. 7 and 8. On the other hand, the shell 21 of the mating connector plug elastically presses the shield cover 16 inwardly and at the same time elastically contacts the spring pieces 29 and 31 to ensure shielding. When the shell 21 of the mating connector plug is inserted to the full, its locking piece 25 is engaged with the engaging hole 24 and is held there by a slider 49 for unlocking use, as shown in FIG. 9.

Figure 10:
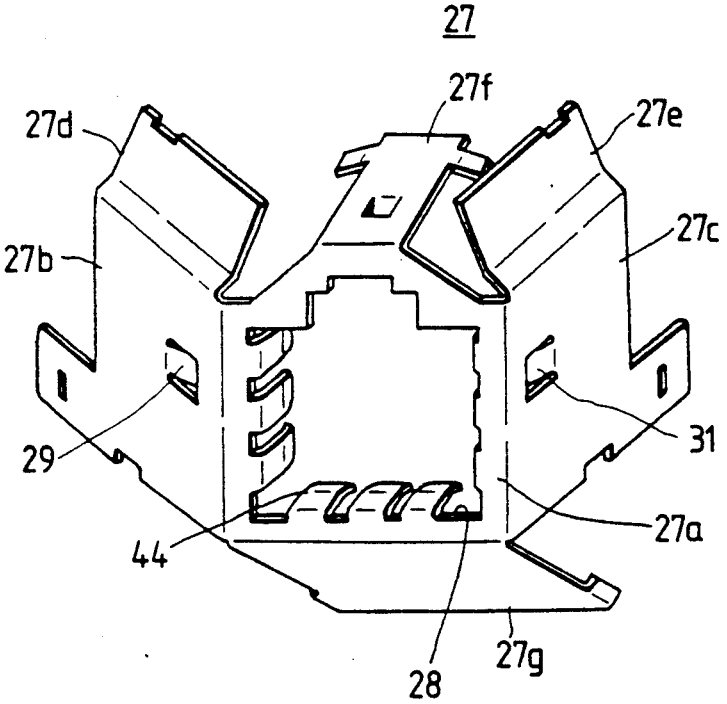
FIG. 10 is a perspective view showing another example of the ground cover forming step.

While in the above disruption the spring pieces 29 and 31 are formed in the side panels 27*b* and 27*d*, it is also possible to provide a plurality of spring pieces 44 which extend rearwardly from the inner marginal edges of the opening 28 of the front panel 27*a* as depicted in FIG. 10. In such an instance, the spring pieces 29 and 31 may be formed so that when the ground cover 27 is put on the case 19, they engage the front marginal edges of the windows 32 and 33 made in the case 19 to prevent the cover 27 from coming off, but the spring pieces 29 and 31 may be omitted.

As described above, according to the present invention, the square tubular portion 19A of the case 19 is covered with the ground cover 27, and when the mating connector plug is inserted into the connector socket, the shell 21 of the plug contacts the shield cover 16 and at the same time elastically contacts the spring pieces 29 and 31 or 44 of the ground cover 27 and is grounded therethrough to the ground of a printed board on which the multipin connector socket is mounted, thus producing the shielding effect.

The lug pieces 36 and 37 of the shield cover 16 are inserted into and engaged with the slots 34 and 35 of the ground cover 27, by which the ground cover 27 put on the case 19 from front and the shield cover 16 inserted thereinto from behind are mechanically coupled with each other and are prevented from coming off the case 19 and at the same time the ground cover 27 is electrically connected to the shield cover 16, further ensuring the shielding effect. Moreover, the ground cover 27 reinforces thin portions of the square tubular portion 19A of the case 19.

It will be apparent that many modifications and variations may be effected without departing from the scope of the novel concepts of the present invention.

What is claimed is:

1. A multipin connector socket comprising:

a rectangular body of insulating material having a plurality of elongated contact housing holes extending therethrough and arranged in rows and columns;

a plurality of socket contacts housed in said contact housing holes of said rectangular body;

a metallic shield cover on said rectangular body;

a case of insulating material on said shield cover, a rectangular groove being defined between said shield cover and said case for receiving a shell of a mating connector plug; and a ground cover on said case, said ground cover being made by punching and bending a metal plate and having an opening in a front end thereof for receiving said mating connector plug, said ground cover including two side panels having slots therein for engagement with lugs set up from said shield cover, and a plurality of spring pieces formed integrally with said ground cover and extending into said rectangular groove.

2. The multipin connector socket of claim 1 wherein said case has side wall which have windows therein, and said spring pieces are formed y butting Ushaped grooves in said side panels of said ground cover, said spring pieces projecting into said rectangular groove through said windows.

3. The multipin connector socket of claim 1, wherein said spring pieces extend from edges of said opening of said ground cover and project into said rectangular groove.

4. The multipin connector socket of claim 1, 2, or 3, wherein said body has a forward section comprising a block portion in which said contact housing holes are located, and a rear section comprising a terminal housing portion formed integrally with said block portion and having an inverted U-shaped cross section.

5. The multipin connector socket of claim 4, wherein said shield cover has a square tubular portion which receives said block portion of said body and a frame portion formed integrally with said square tubular portion at the rear thereof for receiving said terminal housing portion, said frame portion having an inverted U-shaped cross-section.

6. The multipin connector socket of claim 5 wherein said square tubular portion of said shield cover has a pair of upper edges that define slits extending in a direction substantially parallel to said elongated contact housing holes.

7. The multipin connector socket of claim 5 wherein said terminal housing portion of said body is wider and thicker than said block portion, a rear end portion of said square tubular portion of said shield cover being engaged with a forward portion of said terminal housing portion, and a gap being defined between said block portion of said body and said square tubular portion of said shield.

8. The multipin connector socket of claim 5, wherein said lugs are formed on side panels of said frame portion extend outwardly thereof.

* * * * *